United States Patent [19]

Ornros

[11] Patent Number: 4,756,460

[45] Date of Patent: Jul. 12, 1988

[54] HOLDER FOR PAPER ROLLS

[75] Inventor: Lennart Ornros, Silverdalen, Sweden

[73] Assignee: Mo Och Domsjo Aktiebolag, Ornskoldsvik, Sweden

[21] Appl. No.: 26,709

[22] Filed: Mar. 17, 1987

[30] Foreign Application Priority Data

Mar. 17, 1986 [SE] Sweden ..... 8601235-8

[51] Int. Cl.[4] ..... B65D 85/672

[52] U.S. Cl. ..... 225/54; 225/66; 225/77; 225/88; 242/55.54

[58] Field of Search ..... 225/54.61, 80, 77, 88, 225/66, 34, 38; 242/55.54, 55.42; 83/649, 650

[56] References Cited

U.S. PATENT DOCUMENTS

| | | | |
|---|---|---|---|
| 2,382,659 | 8/1945 | Olson | 225/80 X |
| 2,759,545 | 8/1956 | Rizza | 225/61 X |
| 2,876,943 | 3/1959 | Tholstrup | 225/88 X |
| 3,310,167 | 3/1967 | Knox | 242/55.42 |
| 3,539,124 | 11/1970 | Belokin, Jr. | 242/55.54 |
| 3,627,216 | 12/1971 | Ekuan | 242/55.54 |
| 4,524,895 | 6/1985 | Lundén | 225/77 X |
| 4,579,266 | 4/1986 | Bünger et al. | 225/77 X |

*Primary Examiner*—Frank T. Yost

*Attorney, Agent, or Firm*—Sughrue, Mion, Zinn, Macpeak and Seas

[57] ABSTRACT

A paper web (3) forming a roll is drawn therefrom in a direction perpendicular to the roll axis, passed over a direction changing guide edge (4), and is separated from the roll against a tear edge (5) located in the proximity of one end of the roll.

7 Claims, 2 Drawing Sheets

HOLDER FOR PAPER ROLLS

BACKGROUND OF THE INVENTION

The present invention relates to a holder for a paper roll, preferably a roll of soft paper, with which the paper web forming the roll is drawn from the holder in the direction of the roll axis and separated from the roll against a tear edge located in the proximity of one edge part of the paper roll.

There are essentially two types of paper roll holders available at present on the market, e.g. toilet paper holders and holders for household paper. With the first type of holder, the paper is laid in the holder and drawn horizontally therefrom. One drawback with this type of holder, illustrated for example in DE-OS-No. 2552444, is that the paper must be drawn from the holder relatively slowly, in order to prevent the roll from rotating initially too quickly, such as to form a loose length of paper within the holder. A further drawback is that the paper web is drawn from the holder horizontally, which means that the paper must be pulled in a direction that lies substantially at right angles to the axis of the roll, therewith to ensure that the pulling force exerted on the paper web drawn from the holder is not so unevenly distributed as to cause the paper web to be torn unintentionally. Consequently, the holder must be placed in a position suitable herefor, which is often difficult to achieve.

With the second type of holder the paper roll is held vertically, with one end surface of the roll resting on the bottom of the holder. In this case the paper web is drawn downwardly from the centre of the paper roll in the direction of the roll axis, with the roll held stationary in the holder. The drawbacks associated with the first type of holder are thus not found with the second type of holder. However, this second type of holder, illustrated for example in Swedish Patent Specification No. 304 363, is encumbered with the drawback that because the paper roll remains stationary while drawing the paper web therefrom, the web becomes twisted, sometimes to such an exaggerated extend that it can only be separated from the roll with great difficulty, for example by applying powerful tugging forces. Once separated from the remainder of the roll, the paper web has to be smoothed out before it can be used, which can be both laborious and inconvenient.

SUMMARY OF THE INVENTION

Consequently it is a primary object of this invention to provide a paper roll holder of the kind mentioned in the introduction which will (a) enable paper web to be drawn in an optimal direction, i.e. in a downward direction, (b) enable rotational movement of the roll to be restricted to a desired extent, and (c) deliver the paper web in a flat condition.

BRIEF DESCRIPTION OF THE DRAWING

The invention will now be described in more detail with reference to the accompanying drawing, in which.

DETAILED DESCRIPTION OF THE PREFERRED EMBODIMENTS

Figure 1:
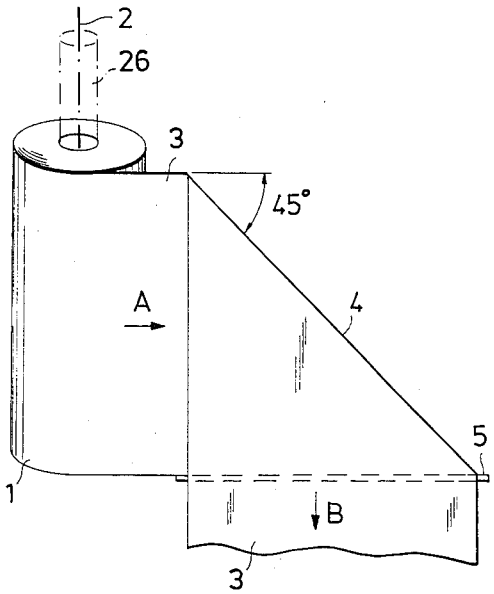
FIG. 1 is a simple illustration of the fundamental principles of the invention.

FIG. 1 illustrates the fundamental principles of the invention. A paper roll, for example a roll of toilet paper or household paper, is positioned so that the longitudinal axis of the roll extends vertically, or at least substantially vertically to the base of a holder, not shown in FIG. 1. The paper web 3 is drawn tangentially from the outer periphery of the roll 1, in the direction of the arrow A, and the roll rotates as the paper web is drawn therefrom. The holder (not shown) incorporates a direction changing edge 4, hereinafter designated web guide edge, which forms an angle of preferably 45° with the axis 2. This angle may vary, however, between 40° and 50°. The paper web is passed over this guide edge 4, which is smoothly rounded, and thereafter extends in the direction of the arrow B, i.e. substantially parallel with the axis 2. Since the roll 1 rotates as the paper web 3 is drawn therefrom, i.e. so that the paper web does not twist, the web will extend in a flat condition from the tear edge 5 of the holder (not shown in FIG. 1), preferably from a location rearwardly of the tear edge, so that the length of paper taken from the roll can be separated therefrom, by drawing the free end of said length obliquely upwards or obliquely downwards. The guide edge 4 is assumed here to be rectilinear and to have the form of a flat metal sheet for example. However, even though a device that presents a rectilinear guide edge 4 has been found highly satisfactory in practice, it has the drawback of taking a relatively large amount of space.

Figure 2:
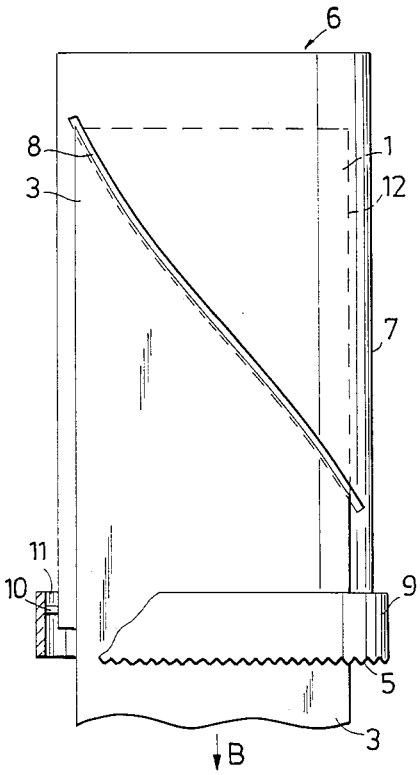
FIG. 2 illustrates one embodiment of the invention.

FIG. 2 illustrates an embodiment which in the main requires no more space than the paper roll 1, from which the paper web is drawn in the aforedescribed manner down to and beneath a serrated tear edge 5. The paper roll holder 6 comprises a round-cylinder 7 which has an open upper end and which has provided in the peripheral wall thereof a slot 8 through which the paper web is passed. The bottom of the cylinder is closed, either completely or partially, to form a support for the roll placed therein. Located in the vicinity of the bottom of the cylinder 7 is a ring 9, which is shown partially cut-away. The ring 9 is attached to the rear of the cylinder 7 by means of studs 10 or the like, and the internal diameter of the ring exceeds the external diameter of the cylinder 7, so as to form a gap 11, which is fully open on the forwardly facing side of the holder arrangement, so as to enable the paper web 3 to be drawn therethrough. In the case of the FIG. 2 embodiment, the rectilinear guide edge 4 illustrated in FIG. 1 is formed on a cylindrical surface and is spaced from the outer peripheral surface 12 of the roll at a distance which remains substantially unchanged along the whole of the guide edge. The helical line thus formed has a pitch of 45°, with possible deviations according to the aforegoing, and results in the aforesaid change in direction of the web 3, i.e. 90°, as the web is drawn from the roll. The length of paper web located beneath the tear edge 5 is separated from the roll 1, by drawing the web against the tear edge.

Figure 3:
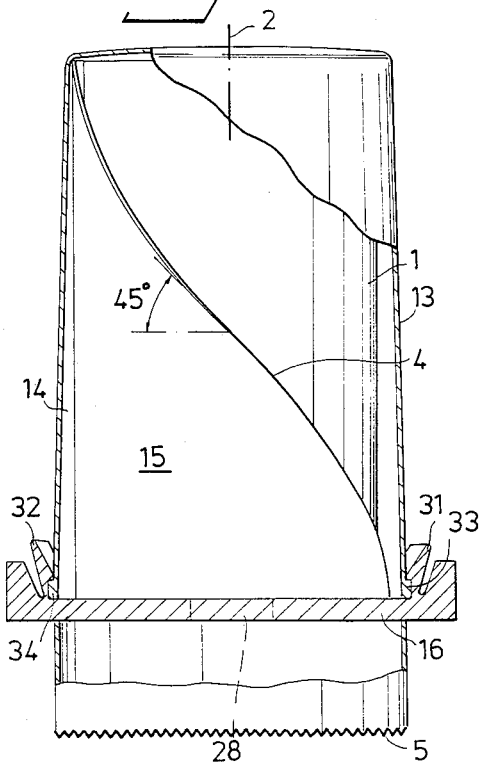
FIG. 3 illustrates another embodiment of the invention.

FIG. 3 illustrates a preferred embodiment of a holder according to the invention. The holder of this embodiment is fitted with an outer protective casing 13, which both shields the paper roll 1 and defines a gap 14 together with the part-cylindrical wall 15 (see FIG. 4) on which the guide edge 4 is formed. As will best be seen from FIGS. 4 and 6, the part-cylindrical wall 15 embraces an angle of approximately 190°, although this angle can vary in dependence on the width of the paper web, and may in the case of toilet paper, for instance, be 90°. The helical guide edge 4 extends from the upper part 19 of the wall 15 to the lower edge part 20 of said wall, at an angle of preferably 45° to the central vertical axis of the roll, as before mentioned, i.e. the helical guide edge has a pitch angle of 45°. The part-cylindrical wall 15 is located on a base plate 16, which supports the paper roll 1. The base plate 16 and the part-cylindrical wall 15 connected thereto together form an insert in the casing 13. In the illustrated embodiment the base plate 16 is provided with two mutually opposed sprung locking means 31 and 32 which, when the insert together with a paper roll is placed in the casing 13, are brought into coaction with a respective one of two locking shoulders 33 and 34 on the casing 13, thereby to secure the insert to the casing. As will be seen from FIG. 5, which shows the casing 13 from one side thereof, the forwardly located part of the casing presents a tear edge 5, which embraces the lower part of the casing through an angle of about 190°. This lower part of the casing has provided therein mutually opposed openings 21, which facilitate the insertion of the insert and the positioning of respective locking means 31, 32 against the locking shoulders 33, 34.

Figure 5:
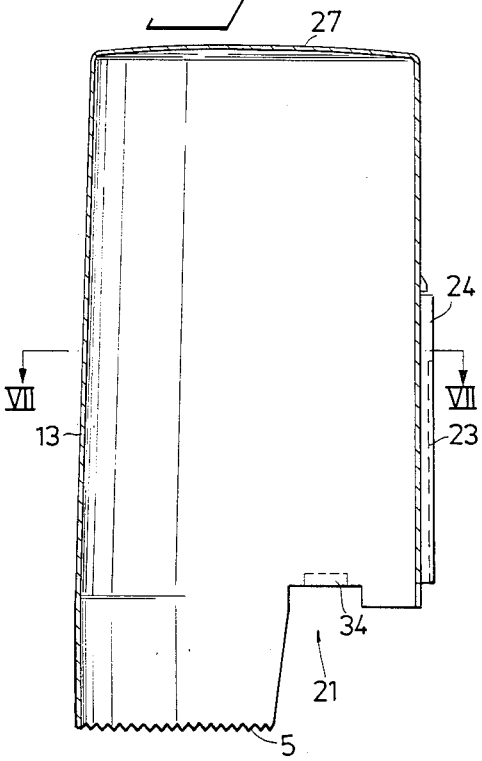
FIG. 5 is a sectional view taken centrally through the casing of the holder illustrated in FIG. 3.
Figure 7:
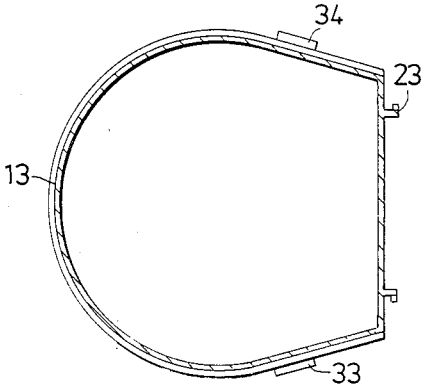
FIG. 7 is a sectional view taken on the line VII—VII in FIG. 5.

As illustrated in FIGS. 5 and 7, the rearwardly located part of the casing 13 has provided thereon guides 23 which are intended to co-operate with corresponding channels provided on an attachment plate 24, which is secured to a structural supporting wall.

Figure 4:
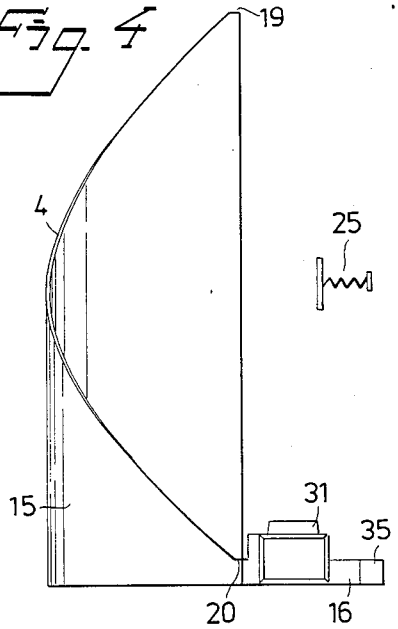
FIG. 4 illustrates the insert in the holder of FIG. 3 turned through 90°.

The embodiment illustrated in FIG. 4 incorporates a spring-loaded pusher 25, which is intended to hold the paper roll 1 pressed against the part-cylindrical wall 15, as the roll progressively decreases in diameter.

In the aforegoing it has been assumed that one end of the paper roll rests freely on a base, or base flange, in the holder, in the absence of any form of guide means. It will be understood, however, that the roll can be guided in a known manner with the aid of a post 26 (FIG. 1) which extends up through the central bore of the roll, either completely or partially. This post may be attached to the lid 27 (FIG. 5) of the casing, or attached to the base plate 16.

Figure 6:
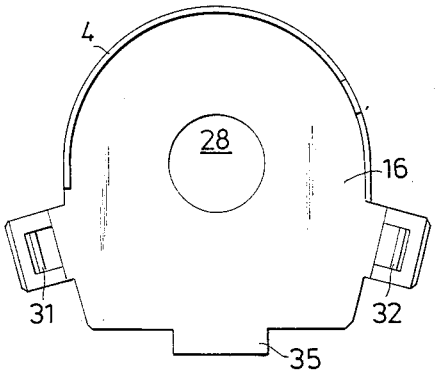
FIG. 6 illustrates the insert of FIG. 4 from above.

As will best be seen from FIG. 7, the forwardly located part of the casing 13 is part-cylindrical, and the edge portions of the part-cylinder merge with the side walls of a frustoconical configuration, when seen in cross-section. FIGS. 4 and 6 illustrates support shoulders 35 which are intended to support the rearwardly located edge part of the casing 13.

The base plate 16 may also be provided with a central aperture, so that the paper web can also be withdrawn from the interior of the roll 1 in a conventional manner, if desired. Such an aperture is indicated at 28 in FIG. 3. The risk of the roll rotating rapidly when unreeling paper therefrom is eliminated partly through the frictional contact of the paper web with the guide edge and/or partly through frictional contact of the bottom of the roll with the base of the holder.

I claim:

1. A dispensing holder for a roll of paper, comprising:

(a) means for rotatably supporting the roll such that an axis (2) thereof is substantially vertically oriented, (b) a guide edge (4) disposed proximate the roll, extending over substantially a full vertical height of the roll, and oriented at an angle of between about 40° and 50° to the roll axis, and (c) a tear edge (5) disposed adjacent an end of the roll, wherein (d) a web of paper is:

(1) withdrawn from an outer peripheral surface of the roll in a direction (A) substantially perpendicular to the roll axis, (2) passed over and against the guide edge such that the web exiting the guide edge extends in a direction (B) substantially parallel to the roll axis, and (3) led past the tear edge for severance at a desired length.

2. A holder according to claim 1, wherein the guide edge (4) is formed on a cylindrical surface (7; 15) which at least partially surrounds the paper roll.

3. A holder according to claim 2, wherein the guide edge (4) comprises an edge part of a part-cylindrical guide means (15) remote from the tear edge (5).

4. A holder according to claim 3, wherein the part-cylindrical guide means (15) includes a base plate (16) provided with a central aperture (28) through which a web of paper can be drawn from a center bore of the roll (1).

5. A holder according to claim 2, wherein the guide edge (4) is formed by a slot (8) which passes through a cylindrical tube (7) encasing the paper roll (1).

6. A holder according to claim 1, wherein the guide edge (4) is rectilinear.

7. A holder according to any one of claims 1–6, wherein the guide edge (4) is gently rounded.

* * * * *